United States Patent [19]

Bland

[11] Patent Number: 4,565,534

[45] Date of Patent: Jan. 21, 1986

[54] WATER PUMP LOCATION FOR MARINE PROPULSION DEVICE

[75] Inventor: Gerald F. Bland, Glenview, Ill.

[73] Assignee: Outboard Marine Corporation, Waukegan, Ill.

[21] Appl. No.: 560,904

[22] Filed: Dec. 14, 1983

[51] Int. Cl.[4] ..... B63H 21/14

[52] U.S. Cl. ..... 440/88; 440/76; 123/41.47

[58] Field of Search ..... 440/88, 89, 39, 52, 440/57, 60, 64, 75, 76; 123/41.47, 41.46, 41.44, 195 P; 417/364; 416/174

[56] References Cited

U.S. PATENT DOCUMENTS

| | | | |
|---|---|---|---|
| 2,905,133 | 9/1959 | Clerk | 440/75 |
| 3,182,629 | 5/1965 | Armantrout | 440/88 |
| 4,265,625 | 5/1981 | Eichinger | 440/75 |

FOREIGN PATENT DOCUMENTS

| | | | |
|---|---|---|---|
| 649901 | 10/1962 | Canada | 123/195 P |
| 697887 | 11/1964 | Canada | 440/75 |
| 949396 | 6/1974 | Canada | 440/88 |
| 2544090 | 4/1976 | Fed. Rep. of Germany . | |

*Primary Examiner*—Trygve M. Blix
*Assistant Examiner*—Edwin L. Swinehart
*Attorney, Agent, or Firm*—Michael, Best & Friedrich

[57] ABSTRACT

A marine propulsion device comprising a propulsion unit, a horizontal drive shaft rotatably supported in the propulsion unit, a second drive shaft rotatably supported in the propulsion unit, and water pump means. The horizontal drive shaft has an aft end, and is adapted to be rotationally driven by an engine. The second drive shaft has upper and lower ends, and extends transversely to the horizontal drive shaft. The second drive shaft is connected to the horizontal drive shaft for rotationally driving the second drive shaft, and is adapted to drive a propeller. The water pump means communicates with the cooling jacket of the engine for circulating water through the cooling jacket, and is drivingly connected to one of the upper end of the second drive shaft and the aft end of the horizontal drive shaft.

13 Claims, 2 Drawing Figures

WATER PUMP LOCATION FOR MARINE PROPULSION DEVICE

BACKGROUND OF THE INVENTION

This invention relates to water pumps for marine propulsion devices, and more particularly to a water pump location for stern drives or inboard/outboard motors. The purpose of the pump is to pick up water from the body of water on which the marine vehicle is operating, and to supply the water to the cooling jacket of the engine.

The impeller in the water pump is commonly made of rubber and is expected to wear with use, requiring replacement at fairly predictable intervals.

A typical location for such a pump is in the propulsion unit, with the pump being mounted on and driven by the vertical drive shaft, and with the drive shaft passing through the pump. This location makes it difficult to service the pump, because the drive train must be disassembled to gain access to the pump.

Another typical location for the pump is on the front of an inboard engine, with the pump being driven by belts and pulleys, or gears. This location is more serviceable, but it is generally more costly due to the distance from the pump to the water source, and to the complexity of the drive mechanism.

Attention is directed to the following U.S. patents which disclose marine propulsion device pump locations:

| Patentee | U.S. Pat. No. | Issued |
|---|---|---|
| Shimanckas | 3,183,880 | May 18, 1965 |
| Kiekhaefer | 3,181,495 | May 4, 1965 |

SUMMARY OF THE INVENTION

The invention provides a marine propulsion device comprising a propulsion unit, a horizontal drive shaft rotatably supported in the propulsion unit, a second drive shaft rotatably supported in the propulsion unit, and water pump means. The horizontal drive shaft has an aft end, and is adapted to be rotationally driven by an engine. The second drive shaft has upper and lower ends, and extends transversely to the horizontal drive shaft. The second drive shaft is connected to the horizontal drive shaft for rotationally driving the second drive shaft, and is adapted to drive a propeller. The water pump means communicates with the cooling jacket of the engine for circulating water through the cooling jacket, and is drivingly connected to one of the upper end of the second drive shaft and the aft end of the horizontal drive shaft.

In one embodiment, the water pump means includes an impeller, the impeller including a drive slot receiving one of the upper end of the second drive shaft and the aft end of the horizontal drive shaft.

In one embodiment, the aft end of the horizontal drive shaft is received in the drive slot in the impeller.

In one embodiment, the upper end of the second drive shaft is received in the drive slot in the impeller.

The invention also provides a marine propulsion device comprising a propulsion unit, a horizontal drive shaft rotatably supported in the propulsion unit, a second drive shaft rotatably supported in the propulsion unit, and water pump means. The horizontal drive shaft has an aft end, and is adapted to be rotationally driven by an engine. The second drive shaft has upper and lower ends, extends transversely to the horizontal drive shaft, and is adapted to drive a propeller. The second drive shaft is connected to the horizontal drive shaft adjacent to the aft end of the horizontal drive shaft and to the upper end of the second drive shaft for rotationally driving the second drive shaft. The water pump means communicates with the cooling jacket of the engine for circulating water through the cooling jacket, and is located adjacent to the point of connection between the horizontal drive shaft and the second drive shaft.

A principal feature of the invention is the location of the water pump at the upper end of the propulsion unit, adjacent to the point of connection between the horizontal drive shaft and the second drive shaft. This allows both low cost design and serviceability.

Another principal feature of the invention is the utilization of an existing shaft for driving the pump. This also allows low cost design.

Other features and advantages of the invention will become apparent to those skilled in the art upon reviewing the following detailed description, the drawings, and the claims.

DESCRIPTION OF THE PREFERRED EMBODIMENT

Figure 1:
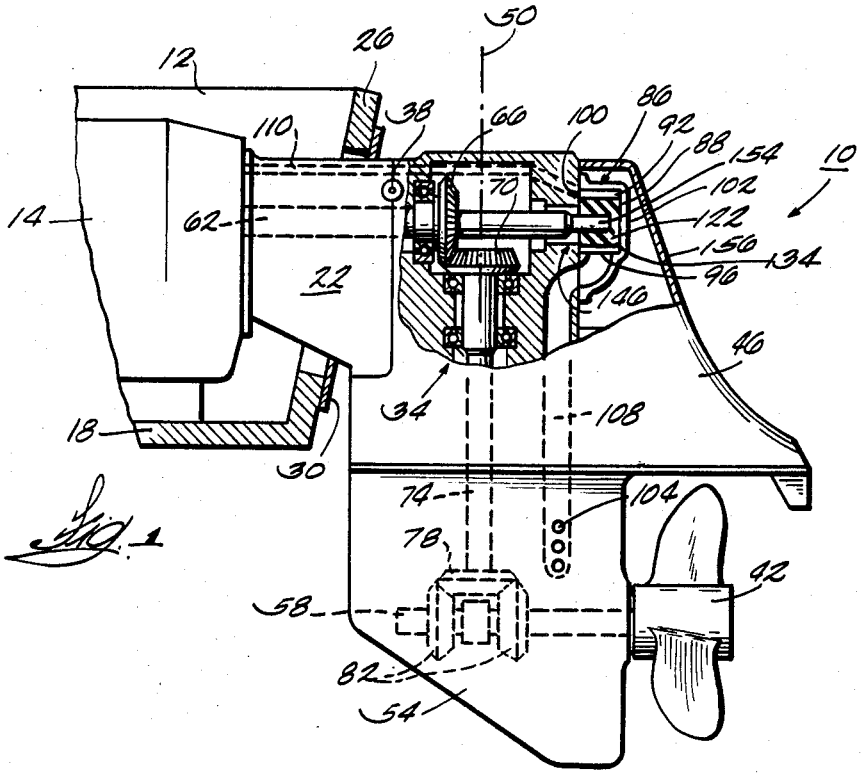
FIG. 1 is a side view of the propulsion unit of a marine propulsion device with a water pump being driven by the aft end of the horizontal drive shaft.
Figure 2:
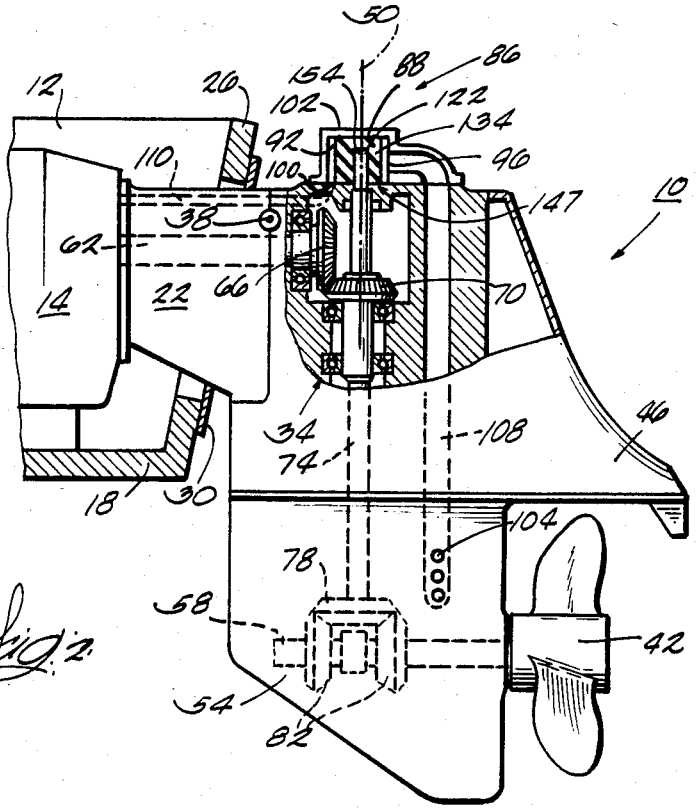
FIG. 2 is a side view of the propulsion unit of a marine propulsion device with a water pump being driven by the upper end of the second drive shaft.

Illustrated in FIGS. 1 and 2 is a marine propulsion device 10 mounted on a boat 12. In this embodiment, the marine propulsion device 10 is of the inboard/outboard of stern drive type, and more specifically, of the engine mounted type. It should be understood that in alternative embodiments, the marine propulsion device 10 could be of the transom mounted type of stern drive.

In this embodiment, the marine propulsion device 10 includes an engine 14 with a cooling jacket. The engine 14 is securely mounted on the boat frame 18.

The marine propulsion device 10 also includes a transom unit 22 mounted on the engine 14 and projecting through the transom 26 of the boat 12. A flexible diaphragm seal 30 surrounds the transom unit 22 and is secured to the transom 26 to exclude water, spray, and exhaust gas from the boat 12.

The marine propulsion device 10 further includes a swivel support 34 pivotally connected to the transom unit 22 for tilting movement in the vertical plane relative to the transom 26 of the boat 12, whereby to provide for movement in the vertical plane about a tilt axis 38 between a lowermost position with a propeller 42 fully submerged in water for driving propulsion and a raised position affording above-water access to the propeller 42.

The marine propulsion device 10 also includes a propulsion unit 46 pivotally mounted on the swivel support 34 for steering movement of the propulsion unit 46 in the horizontal plane, about a steering axis 50. The propulsion unit 46 includes a gear case 54 housing the propeller shaft 58, on which the propeller 42 is mounted.

As further illustrated in FIGS. 1 and 2, the engine 14 drives a horizontal drive shaft 62. A bevel gear 66 on the horizontal drive shaft 62 drives a bevel gear 70 on the upper end of a second drive shaft 74, for rotational driving of the second drive shaft 74. The lower end of the second drive shaft 74 is connected to a driving gear 78. A pair of driven gears 82 are selectively clutched to the propeller shaft 58 to transmit forward or reverse motion to the propeller shaft 58 from the driving gear 78 on the second drive shaft 74.

A water pump 86 is provided to supply cooling water to the cooling jacket of the engine 14. The water pump 86 comprises a housing 88 including a pump chamber 92, a water inlet 96, and a water outlet 100. Covering the pump 86 is an outer housing 102 which can be removed in order to service the pump 86. Openings in the side of the propulsion unit 46 form a water intake 104. A passage 108 connects the water intake 104 to the water inlet 96 of the pump 86. The water outlet 100 is connected to a passage 110 which carries water to the engine cooling jacket.

The water pump 86 further comprises an impeller 122 within the housing 88. The impeller 122 has a plurality of flexible vanes 134 extending radially outwardly therefrom.

In the embodiment illustrated in FIG. 1, the water pump 86 is located at the aft end of the horizontal drive shaft 62. It should be understood that in alternative embodiments the water pump 86 could be located anywhere adjacent to the engaged bevel bears 70 and 74, in the upper portion of the propulsion unit 46.

Means 146 are provided for driving the impeller 122 with the horizontal drive shaft 62. While various suitable means could be employed for this purpose, in the specified construction illustrated, the means 146 includes the aft end of the horizontal drive shaft 62 extending into the pump chamber 92, and a drive slot 154 in the impeller 122 receiving the drive shaft 62. It is to be understood that alternative means for driving the impeller 122 with the drive shaft 62 need not include the drive shaft 62 extending into the pump chamber 92 and being received in the drive slot 154. Examples of such alternative means include having a shaft drivingly connected to the horizontal drive shaft 62 drive the pump 86, or having belts and pulleys or gears drivingly connect the drive shaft 62 to the pump 86.

In the embodiment illustrated in FIG. 1, with the water pump 86 located at the aft end of the horizontal drive shaft 62, the water pump 86 and the outer housing 102 are contained within the propulsion unit 46. To allow easy access to the pump 86 for servicing, the propulsion unit 46 includes a removable portion 156. By tilting the propulsion unit 46 upward about the tilt axis 38, as described previously, even better access to the pump 86 is afforded.

In an alternative embodiment, as illustrated in FIG. 2, the water pump 86 is located at the upper end of the second drive shaft 74. Means 147 are provided for driving the impeller 122 with the second drive shaft 74. While various suitable means could be employed for this purpose, in this embodiment the means 147 includes the upper end of the second drive shaft 74 extending into the pump chamber 92, and a drive slot 154 in the impeller 122 receiving the second drive shaft 74. Again it should be understood that alternative means for driving the impeller 122 with the drive shaft 74 need not include the drive shaft 74 extending into the pump chamber 92 and being received in the drive slot 154. Examples of such alternative means include having a shaft drivingly connected to the second drive shaft 74 drive the pump 86, or having belts and pulleys or gears drivingly connect the drive shaft 74 to the pump 86.

In this alternative embodiment illustrated in FIG. 2, with the water pump 86 located at the upper end of the second drive shaft 74, the water pump 86 and the outer housing 102 sit on top of the propulsion unit 46. To gain access to the pump 86, it is only necessary to remove the outer housing 102. By tilting the propulsion unit 46 upward about the tilt axis 38, even better access to the pump 86 is afforded.

Various features of the invention are set forth in the following claims.

I claim:

1. A marine propulsion device comprising a propulsion unit, water pump means communicating with an engine cooling jacket for circulating water through the cooling jacket, a vertically extending drive shaft rotatably supported in said propulsion unit and having an upper end and a lower end adapted to drive a propeller, and a horizontally extending drive shaft rotatably supported in said propulson unit, driven by an engine, extending forwardly from and drivingly connected to said vertically extending drive shaft, and having an aft end, one of said upper end of said vertically extending drive shaft and said aft end of said horizontally extending drive shaft being located beyond the connection of said horizontally and vertically extending drive shafts, said one of said upper end of said vertically extending drive shaft and said aft end of said horizontally extending drive shaft extending into and driving said water pump means.

2. A marine propulsion device in accordance with claim 1 wherein said aft end of said horizontally extending drive shaft is drivingly connected to said water pump means.

3. A marine propulsion device in accordance with claim 1 wherein said upper end of said vertically extending drive shaft is drivingly connected to said water pump means.

4. A marine propulsion device in accordance with claim 1 wherein said water pump means includes an impeller, said impeller including a drive slot receiving said one of said upper end of said vertically extending drive shaft and said aft end of said horizontally extending drive shaft.

5. A marine propulsion device in accordance with claim 4 wherein said aft end of said horizontally extending drive shaft is received in said drive slot in said impeller.

6. A marine propulsion device in accordance with claim 4 wherein said upper end of said vertically extending drive shaft is received in said drive slot in said impeller.

7. A marine propulsion device comprising a transom unit adapted to extend through the transom of a boat, a swivel support pivotally mounted on said transom unit for vertical tilting movement about a horizontal tilt axis, a propulsion unit having an upper portion connected to said swivel support for common movement therewith and a lower portion pivotally connected to said upper portion for steering movement about a steering axis transverse to said tilt axis, water pump means communicating with an engine cooling jacket for circulating water through the cooling jacket, a vertically extending drive shaft rotatably supported in said upper portion of said propulsion unit and having an upper end and a lower end, a propeller shaft rotatably supported in said lower portion of said propulsion unit and connected to said lower end of said vertically extending drive shaft for rotationally driving said propeller shaft, a propeller mounted on said propeller shaft, and a horizontally extending drive shaft rotatably supported in said propulsion unit, driven by an engine, extending forwardly from and drivingly connected to said vertically extending drive shaft, and having an aft end, one of said upper end of said vertically extending drive shaft and said aft end of said horizontally extending drive shaft being located beyond the connection of said horizontally and vertically extending drive shafts, said one of said upper end of said vertically extending drive shaft and said aft end of said horizontally extending drive shaft extending into and driving said water pump means.

8. A marine propulsion device in accordance with claim 7 wherein said aft end of said horizontally extending drive shaft is drivingly connected to said water pump means.

9. A marine propulsion device in accordance with claim 7 wherein said upper end of said vertically extending drive shaft is drivingly connected to said water pump means.

10. A marine propulsion device in accordance with claim 7 wherein said water pump means includes an impeller, said impeller including a drive slot receiving said one of said upper end of said vertically extending drive shaft and said aft end of said horizontally extending drive shaft.

11. A marine propulsion device in accordance with claim 10 wherein said aft end of said horizontally extending drive shaft is received in said drive slot in said impeller.

12. A marine propulsion device in accordance with claim 10 wherein said upper end of said vertically extending drive shaft is received in said drive slot in said impeller.

13. A marine propulsion device comprising a propulsion unit, water pump means communicating with an engine cooling jacket for circulating water through the cooling jacket, a vertically extending drive shaft rotatably supported in said propulsion unit and having an upper end and a lower end adapted to drive a propeller, and a horizontally extending drive shaft rotatably supported in said propulsion unit, driven by an engine, extending forwardly from and drivingly connected to said vertically extending drive shaft, and having an aft end, one of said upper end of said vertically extending drive shaft and said aft end of said horizontally extending drive shaft being located beyond the connection of said horizontally and vertically extending drive shafts, and extending into and driving said water pump means.

* * * * *